US006199390B1

(12) United States Patent
Mukohara et al.

(10) Patent No.: US 6,199,390 B1
(45) Date of Patent: Mar. 13, 2001

(54) AIR-CONDITIONING CONTROL INFORMATION DISPLAY METHOD AND AIR-CONDITIONING CONTROLLER

(75) Inventors: Shoji Mukohara; Kinya Miyazaki; Taichi Isizaka, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/355,997

(22) PCT Filed: Dec. 25, 1997

(86) PCT No.: PCT/JP97/04851

§ 371 Date: Oct. 22, 1999

§ 102(e) Date: Oct. 22, 1999

(87) PCT Pub. No.: WO99/34151

PCT Pub. Date: Jul. 8, 1999

(51) Int. Cl.[7] ..... F24F 11/02
(52) U.S. Cl. ..... 62/127; 236/94
(58) Field of Search ..... 62/125, 126, 127, 62/129, 130, 131; 165/11.1; 236/94

(56) References Cited

FOREIGN PATENT DOCUMENTS 54-523 5/1979 (JP) .
2-133898 5/1990 (JP) .
2-275328 11/1990 (JP) .
4-39564 2/1992 (JP) .
9-257293 9/1997 (JP) .

*Primary Examiner*—Harry B. Tanner
(74) *Attorney, Agent, or Firm*—Oblon, Spivak, McClelland, Maier, Neustadt, P.C.

(57) ABSTRACT

A method of displaying air-conditioning management information including selecting an extracting position corresponding to a specific room for a layout image of a floor having a plurality of rooms, displaying a partial image extracted from the layout image of the floor having the plurality of rooms such that the partial image shows the specific room at the extracting position together with operating-state data on at least one air conditioner assigned to the specific room, and shifting the extracting position in units of rooms. Correspondingly, an air-conditioning management apparatus includes an image storage device in which a layout image of the floor having a plurality of rooms is stored, an image display extracting device which selects an extracting position and extracts from the layout image a partial image based on the extracting position and corresponding to a specific room, an image display device which displays the partial image together with operating-state data on at least one of the air conditioners assigned to each room, and an extracting-position shifting device which shifts in units of rooms the extracting position of the partial image to be extracted from the layout image.

7 Claims, 20 Drawing Sheets

OPERATING-STATE DATA "0" : BEING STOPPED

OPERATING-STATE DATA "1" : BEING OPERATED

OPERATING-STATE DATA "2" : OUT OF ORDER

BACKGROUND ART FIG. 20
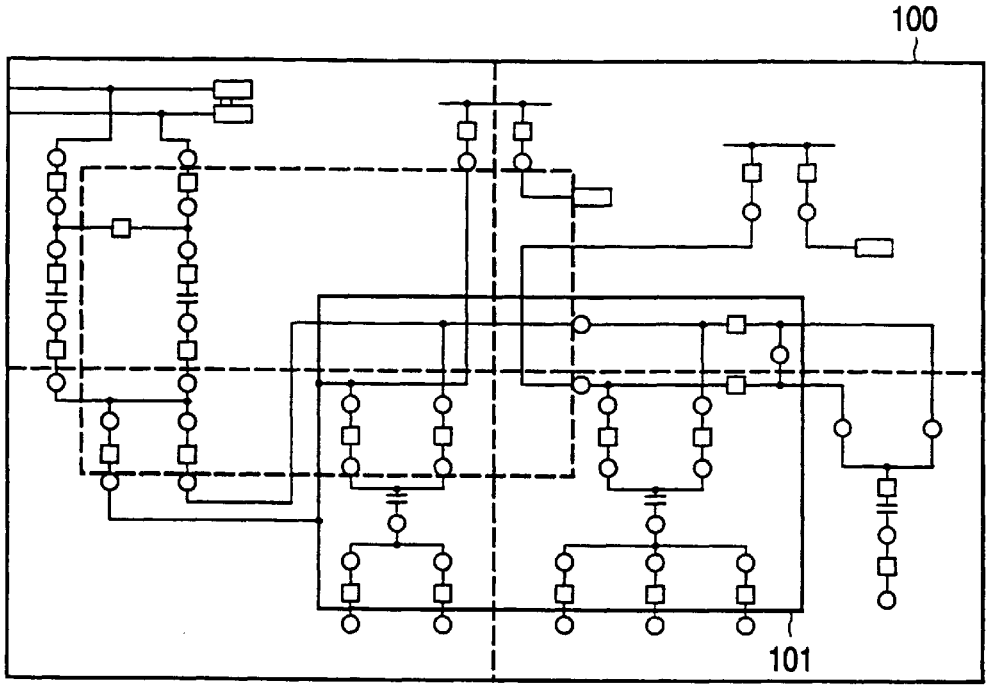
BACKGROUND ART FIG. 21
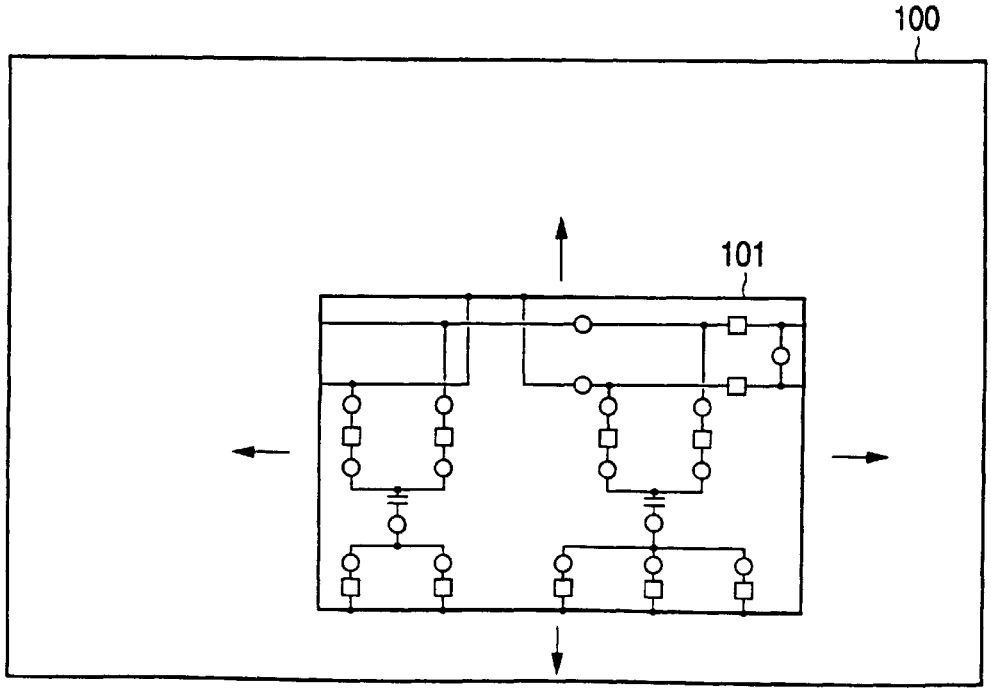

AIR-CONDITIONING CONTROL INFORMATION DISPLAY METHOD AND AIR-CONDITIONING CONTROLLER

TECHNICAL FIELD

The present invention relates to a method of displaying air-conditioning management information for displaying information on management of a plurality of air conditioners, and an air-conditioning management apparatus for managing a plurality of air conditioners on a centralized basis.

BACKGROUND ART

As a conventional example of a general management apparatus, one disclosed in Japanese Patent Application Laid-Open No. 523/1979 (Method of Controlling Display of Monitoring Apparatus) is known. Hereafter, a description will be given of this conventional example.

As shown in FIG. 20, the conventional management apparatus is an apparatus in which a partial image 101 is extracted from an overall image 100 showing the state of a process in an electric power system, and this partial image 101 is displayed on a CRT. This conventional management apparatus is provided with a track ball, and as an operator manipulates the track ball, the screen displayed on the CRT can be scrolled, as shown in FIG. 21.

With such a conventional management apparatus, it is necessary to repeatedly execute the scrolling operation a number of times until the targeted partial image 101 is displayed by scrolling the screen displayed on the CRT, so that the operational efficiency has been poor and presented a problem. In addition, it is difficult for the operator to judge whether the partial image 101 being displayed on the CRT is displaying an end of the overall image 100 or is displaying the center of the overall image 100, so that the ease of use has been poor and constituted a problem.

SUMMARY OF THE INVENTION

An object of the present invention is to provide a method of displaying air-conditioning management information and an air-conditioning management apparatus which are capable of overcoming the above-described problems, make it possible to scroll the screen to a targeted partial image with a fewer number of operations, and excel in the operational efficiency. Another object of the present invention is to provide a method of displaying air-conditioning management information and an air-conditioning management apparatus which are readily capable of judging which position of the overall image the partial image being displayed on the CRT is displaying, and which are capable of preventing a malfunction and excel in reliability.

DISCLOSURE OF THE INVENTION

A method of displaying air-conditioning management information in accordance with the present invention is characterized by comprising the steps of: displaying an image in which a partial image is extracted from a layout image of a floor having a plurality of rooms, and the partial image with operating-state data on an air conditioner added thereto is displayed on a display; and shifting an extracting position in which a position of the partial image to be extracted from the layout image is shifted in units of rooms.

In the addition, an air-conditioning management apparatus in accordance with the present invention for managing a plurality of air conditioners on a centralized basis by displaying on a display data on operating states of the air conditioners disposed in each room on a floor is characterized by comprising: image storage means in which a layout image of the floor is stored; image display means for extracting a partial image from the layout image stored in the image storage means, and for displaying on the display the partial image with the operating-state data added thereto; and extracting-position shifting means for shifting in units of rooms a position of the partial image to be extracted from the layout image.

Here, the air-conditioning management apparatus preferably further comprises: partition-line-data storage means in which partition-line data for partitioning the floor into the rooms is stored, wherein the extracting-position shifting means shifts in units of rooms the position of the partial image to be extracted from the layout image on the basis of the partition-line data read from the partition-line-data storage means.

In addition, the partial image is preferably an image including the entire desired room and portions of rooms adjacent to that room.

Further, the air-conditioning management apparatus preferably further comprises: shift switches each adapted to specify a shifting direction at a time when the position of the partial image to be extracted is shifted by the extracting-position shifting means, wherein the shift switches nullifies inputs with respect to unshiftable directions.

Still further, the shift switches are preferably arrow buttons for various directions displayed on a touch panel, and only the arrow buttons in shiftable directions are displayed.

Furthermore, preferably, the layout images concerning a plurality of floors are stored in the image storage means, and the image display means displays on the display the partial image concerning the floor designated among the floors.

BRIEF DESCRIPTION OF THE DRAWINGS

FIG. 20 is a diagram illustrating an overall image concerning the state of a process in an electric power system used in a conventional management apparatus; and FIG. 21 is a diagram illustrating a partial image which is displayed on a CRT by the conventional management apparatus.

BEST MODE FOR CARRYING OUT THE INVENTION

Referring now to the accompanying drawings, a description will be given of the embodiments of the present invention.

First Embodiment

Figure 1:
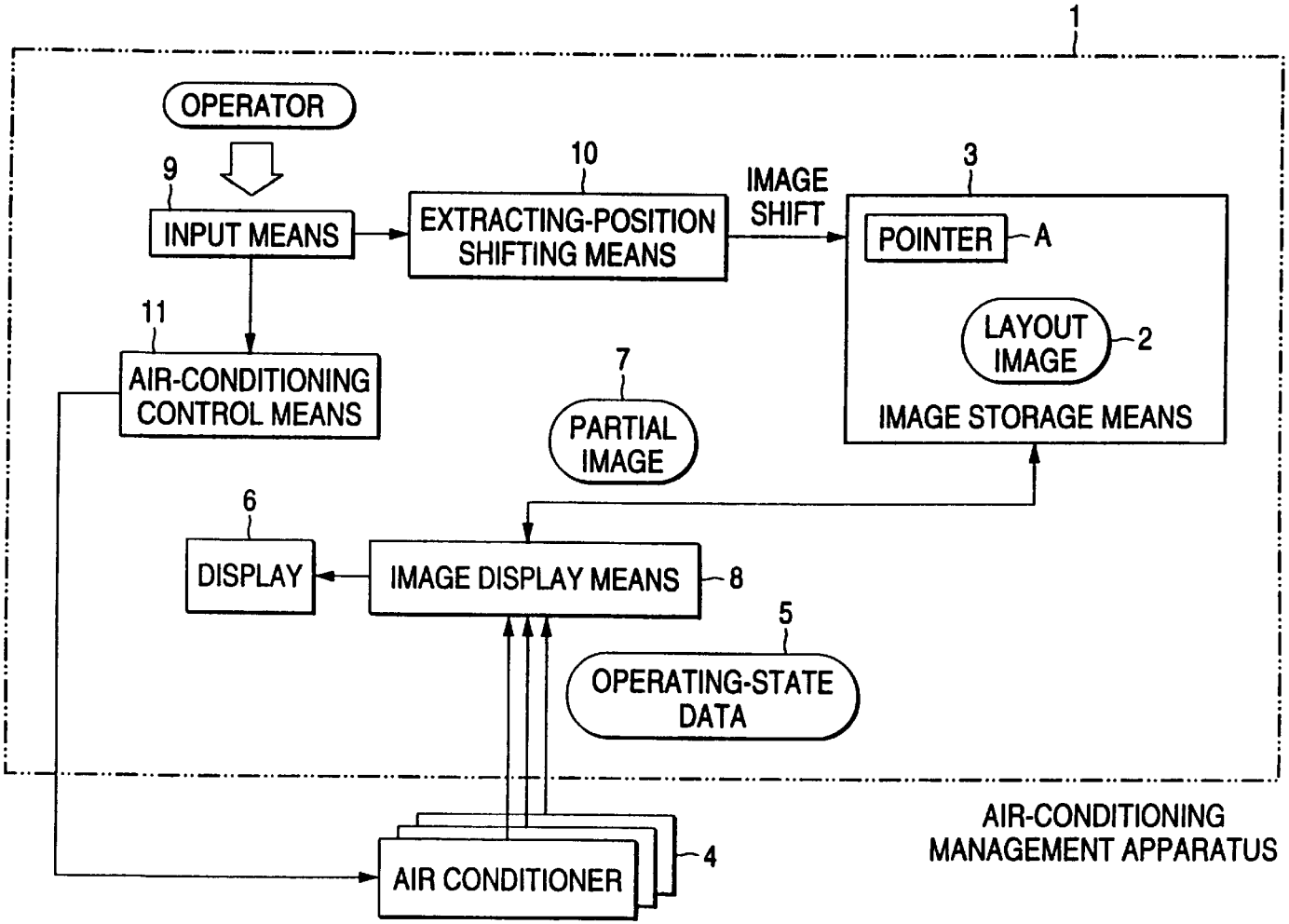
FIG. 1 is a block diagram illustrating an air-conditioning management apparatus in accordance with a first embodiment.

FIG. 1 is a block diagram illustrating an air-conditioning management apparatus 1 in accordance with a first embodiment. As shown in FIG. 1, the air-conditioning management apparatus 1 is provided with an image storage means 3 in which a floor layout image 2 and a pointer A for accessing this layout image 2 are stored; a display 6 for displaying an image including operating-state data 5; and an image display means 8 for extracting a partial image 7 from the layout image 2 stored in the image storage means 3 and for displaying on the display 6 the partial image 7 with the operating-state data 5 added thereto.

The air-conditioning management apparatus 1 is further provided with an input means 9 for accepting an input of shift information for scrolling the display screen of the display 6 and an input of control information for controlling air conditioners 4; a extracting-position shifting means 10 for shifting the position of the partial image 7 to be extracted from the layout image 2 in units of rooms on the basis of the shift information accepted by the input means 9; and air-conditioning control means 11 for controlling the air conditioners 4 on the basis of the control information accepted by the input means 9.

Figure 2:
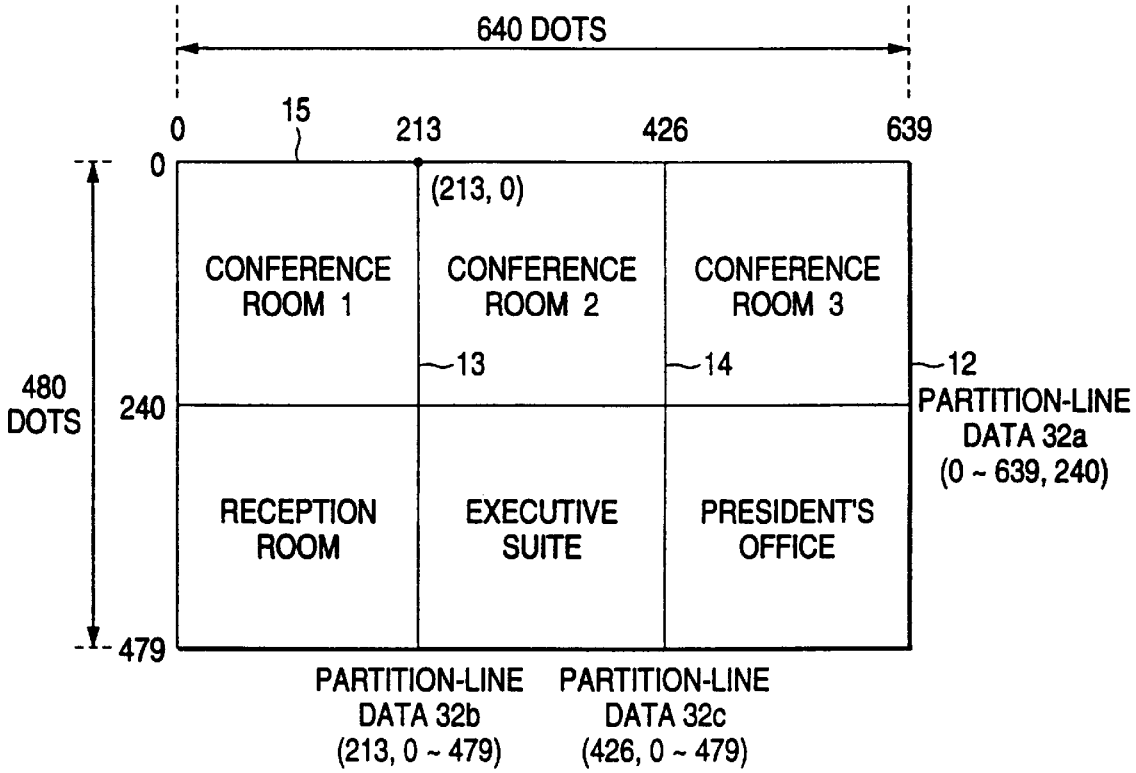
FIG. 2 is a diagram illustrating a configuration of a layout image.

As shown in FIG. 2, the layout image 2 is rectangular graphic data 640 dots wide by 480 dots high, and has addresses 0 D 639 in the direction of the horizontal axis and addresses 0 D 479 in the direction of the vertical axis. The layout image 2 is provided with one partition line 12 extending in the horizontal direction and two partition lines 13 and 14 extending in the vertical direction. The six blocks divided by these partition lines 12 to 14 respectively correspond to the rooms within the floor. The sizes of the blocks may be changed in conformity with the sizes of the respective rooms, or the blocks may be set to the same size as in this example. Further, names of rooms, such as conference rooms 1 to 3, reception room, executive suite, and president's office are written in upper portions of the blocks.

Figure 3:
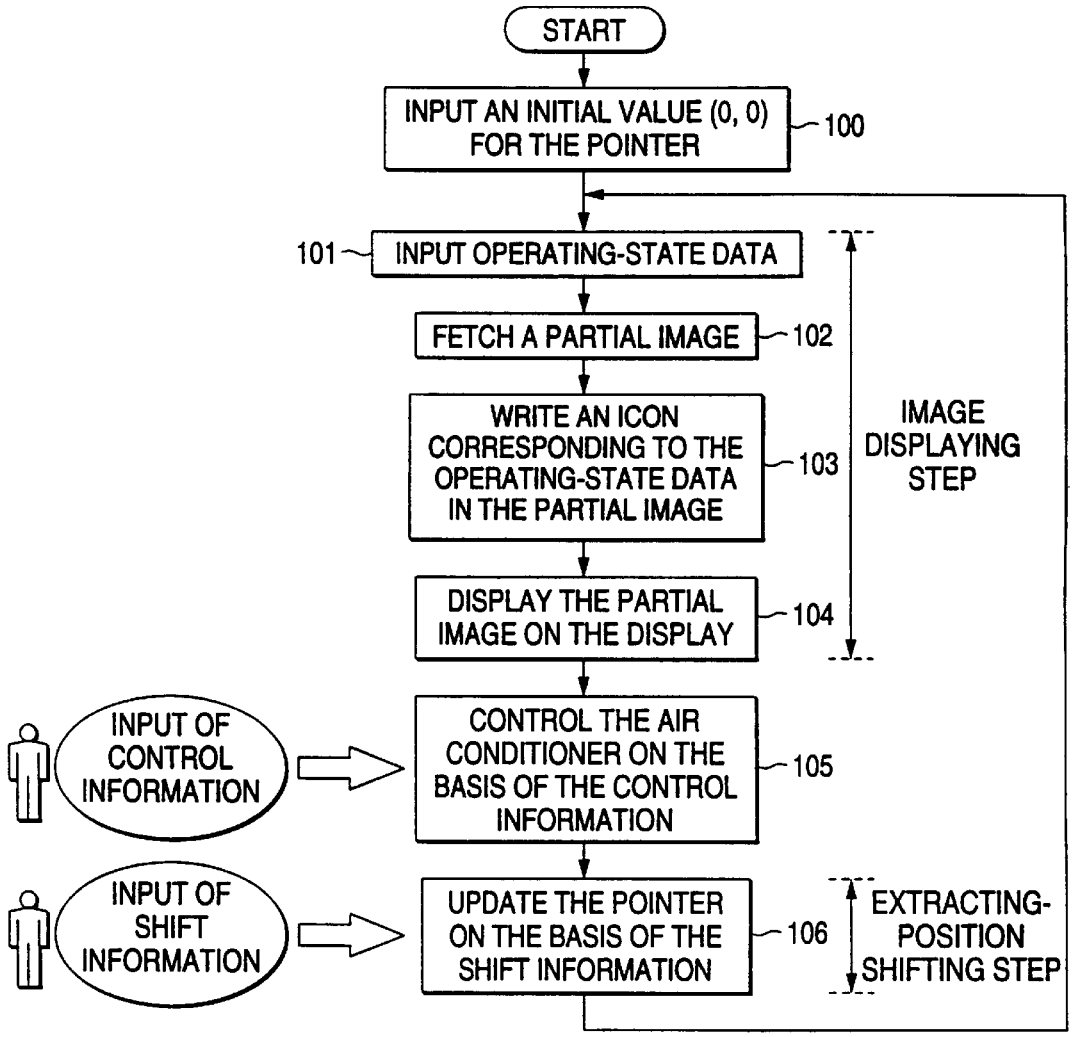
FIG. 3 is a flowchart illustrating the operation of the air-conditioning management apparatus in accordance with the first embodiment.

Next, referring to the flowchart shown in FIG. 3, a description will be given of the operation of the air-conditioning management apparatus 1. The air-conditioning management apparatus 1 is an apparatus for managing the plurality of air conditioners 4 disposed in the respective rooms on the floor on a centralized basis, and is capable of displaying the operating states of these air conditioners 4 on the display 6. First, an initial value address (0, 0) is set for the pointer A for accessing the layout image 2 (Step 100).

Next, a plurality of pieces of operating-state data 5 sent from the respective air conditioners 4 are imparted to the image display means 8 (Step 101). Further, the partial image 7, which is a partial image of the layout image 2, is extracted from the image storage means 3 and is imparted to the image display means 8 (Step 102). Here, an area which is formed by 0th to 213th dots in the direction of the horizontal axis and 0th to 240th dots in the direction of the vertical axis by using the address (0, 0) shown by the pointer A as a starting point is extracted as the partial image 7. This partial image 7 corresponds to a one-block portion obtained by dividing the layout image 2 by the partition lines 12 to 14, and the size of this partial image 7 is equal to the display size of the display 6. For this reason, an image of a one-room portion is displayed on the display 6.

Figure 4:
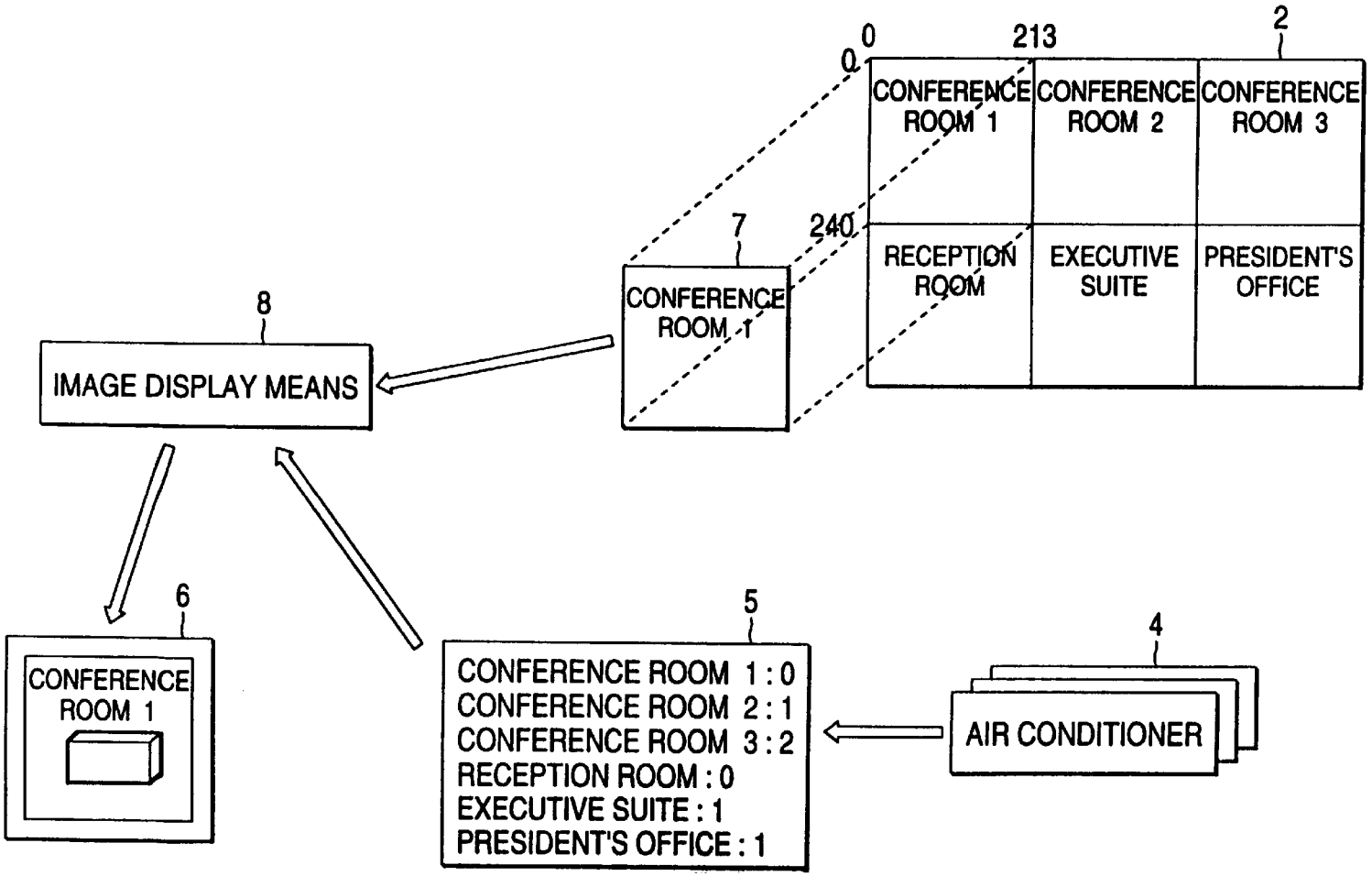
FIG. 4 is a diagram illustrating a partial image in which an icon has been synthesized by an image display means.

Through the processing in Steps 101 and 102, the operating-state data 5 and the partial image 7 are inputted to the image display means 8, as shown in FIG. 4. The image display means 8 checks the operating-state data 5 of the air conditioner 4 in the conference room 1 corresponding to the partial image 7, and writes an icon corresponding to this operating state in a lower portion of the partial image 7 (Step 103). The operating-state data 5 is data which represents the operating states of the air conditioners 4 by numerals, wherein "0" denotes that the air conditioner is being stopped, "1" denotes that the air conditioner is operating, and "2" denotes that the air conditioner is out of order.

Figure 5:
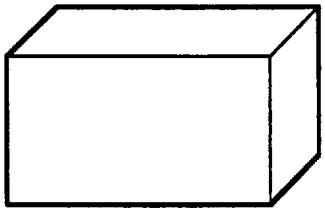
FIG. 5 is a diagram illustrating three kinds of icons prepared in correspondence with operating states.
Figure 5:
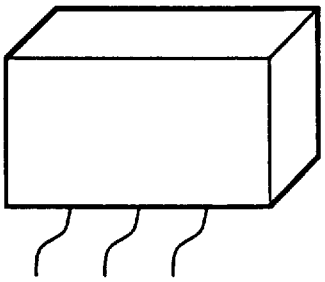
Figure 5:
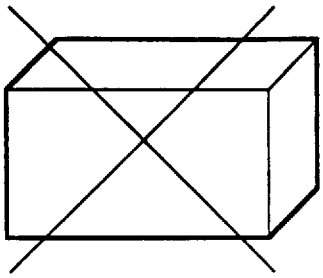

As shown in FIG. 5, a plurality of kinds of icons are prepared according to these operating states, and an icon which corresponds to the operating-state data 5 is selected. It should be noted that the data written in the lower portion of the partial image 7 may not be an icon, and may be character data such as "AIR CONDITIONER IS BEING OPERATED," "AIR CONDITIONER IS BEING STOPPED," "AIR CONDITIONER IS OUT OF ORDER."

Subsequently, the partial image 7 where the icon is written is displayed on the display 6 (Step 104), so that the operator is capable of ascertaining the operating state of the air conditioner 4 installed in the conference room 1. Namely, from the display on the display 6 shown in FIG. 4, the operator is able to understand that the air conditioner 4 in the conference room 1 is being stopped.

Then, if the operator who viewed the display on the display 6 inputted the control information for starting the air conditioner 4 to the input means 9, this control information is imparted to the air-conditioning control means 11. This control information is transmitted to the air conditioner 4, which in turn starts operation on the basis of the control information. In addition, the operator is also able to input control information for changing the set temperature for the air conditioner 4. This control information is also transmitted to the air conditioner 4 via the air-conditioning control means 11, and the set temperature for the air conditioner 4 is changed on the basis of the control information (Step 105).

Next, if the operator inputted shift information to the input means 9 to allow the operating state of the air conditioner 4 in another room to be displayed on the display 6, this shift information is imparted to the extracting-position shifting means 10. In the extracting-position shifting means 10, the pointer A of the image storage means 3 is updated on the basis of this shift information (Step 106). Namely, the extracting-position shifting means 10 accesses the layout image 2 stored in the image storage means 3, and scans the layout image 2 from the present position of the pointer in the scrolling direction. Then, the position of the partition line detected by this scanning becomes a new position of the pointer.

Figure 6:
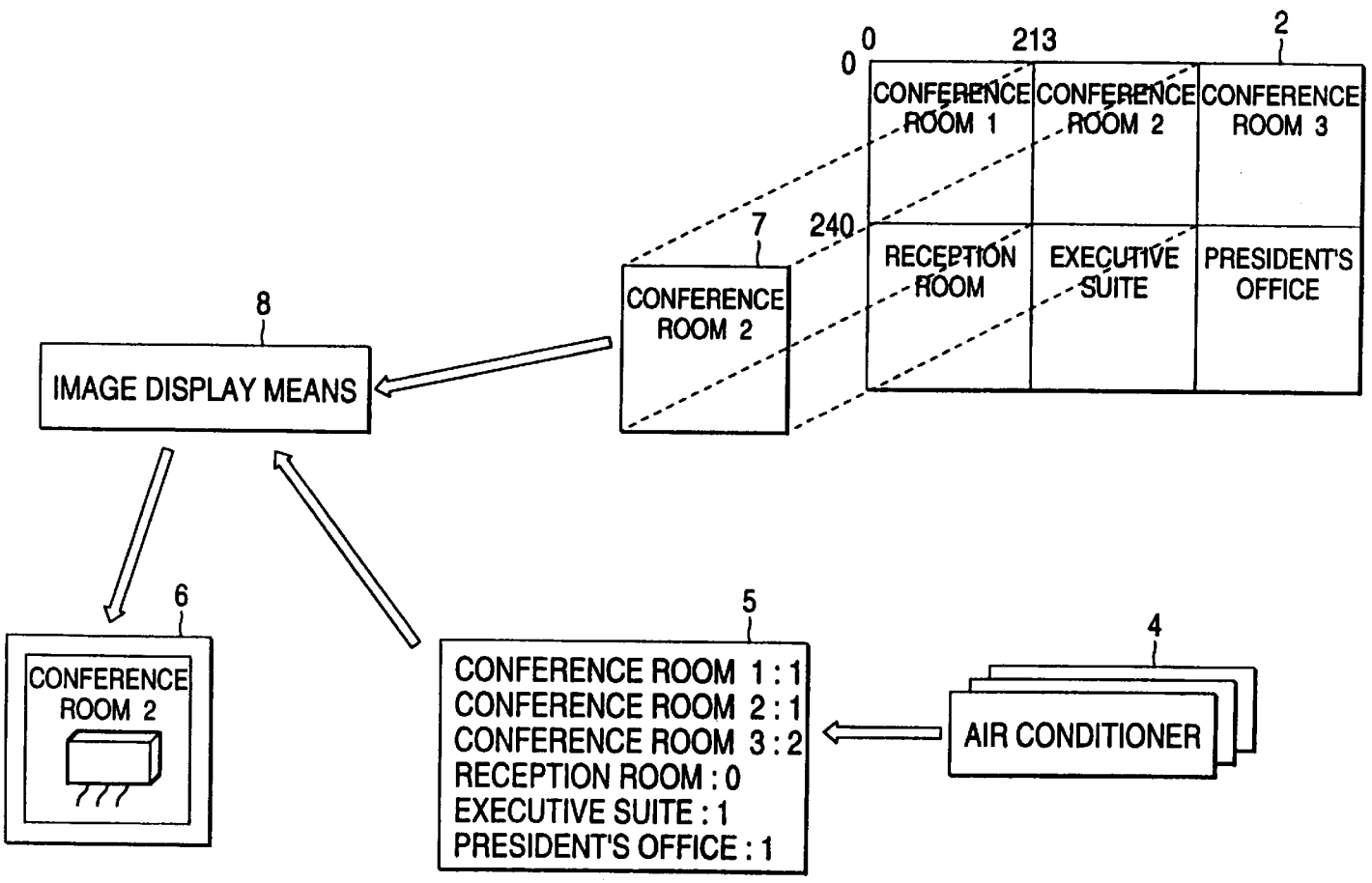
FIG. 6 is a diagram illustrating the partial image in which an icon has been synthesized by the image display means.

Specifically, in a case where the shift information is an instruction for scrolling the image in the rightward direction, the layout image 2 shown in FIG. 2 is scanned in the rightward direction from the position of the address (0, 0), and the partition line 13 is detected at the 213th dot. As a result, the new address of the pointer A becomes (213, 0). Subsequently, the processing returns to Step 101 to impart the operating-state data 5 to the image display means 8. As described above, since the air conditioner 4 in the conference room 1 has already been started, in the operating-state data 5 shown in FIG. 6, the operating state of the conference room 1 has been changed to "1."

Next, the processing in Step 102 is executed to extract the partial image 7 from the image storage means 3, and this partial image 7 is imparted to the image display means 8. Since the address of the pointer A here is (213, 0), an area which is formed by 213th to 426th dots in the direction of the horizontal axis and 0th to 240th dots in the direction of the vertical axis is extracted as the partial image 7. Then, the processing in Steps 103 and 104 is executed to write the icon in the partial image 7 and display the same on the display 6. From this display, the operator is able to understand that the air conditioner 4 installed in the conference room 2 is being presently operated. Subsequently, as the operator inputs control information or shift information, the processing in Steps 105 and 106 is executed to effect the control of the air conditioner 4 and the like.

As the position of the partial image 7 to be extracted is shifted in units of rooms as described above, the display screen can be scrolled to an adjacent room by a single operation irrespective of the size of the room. Thus, since the display screen can be scrolled simply to the partial image 7 of the targeted air conditioner 4 with a small number of operations, the operating state of the air conditioner 4 in each room can be ascertained speedily without exception. In addition, by using the display 6 having a small display screen, it is possible to reduce the product cost.

It should be noted that the processing in Steps 101 to 104 corresponds to the step of displaying an image in which the partial image 7 with the operating-state data 5 added thereto is displayed on the display 6. In addition, the processing in Step 106 corresponds to the step of shifting an extracting position in which the position of the partial image 7 to be extracted is shifted in units of rooms.

Figure 7:
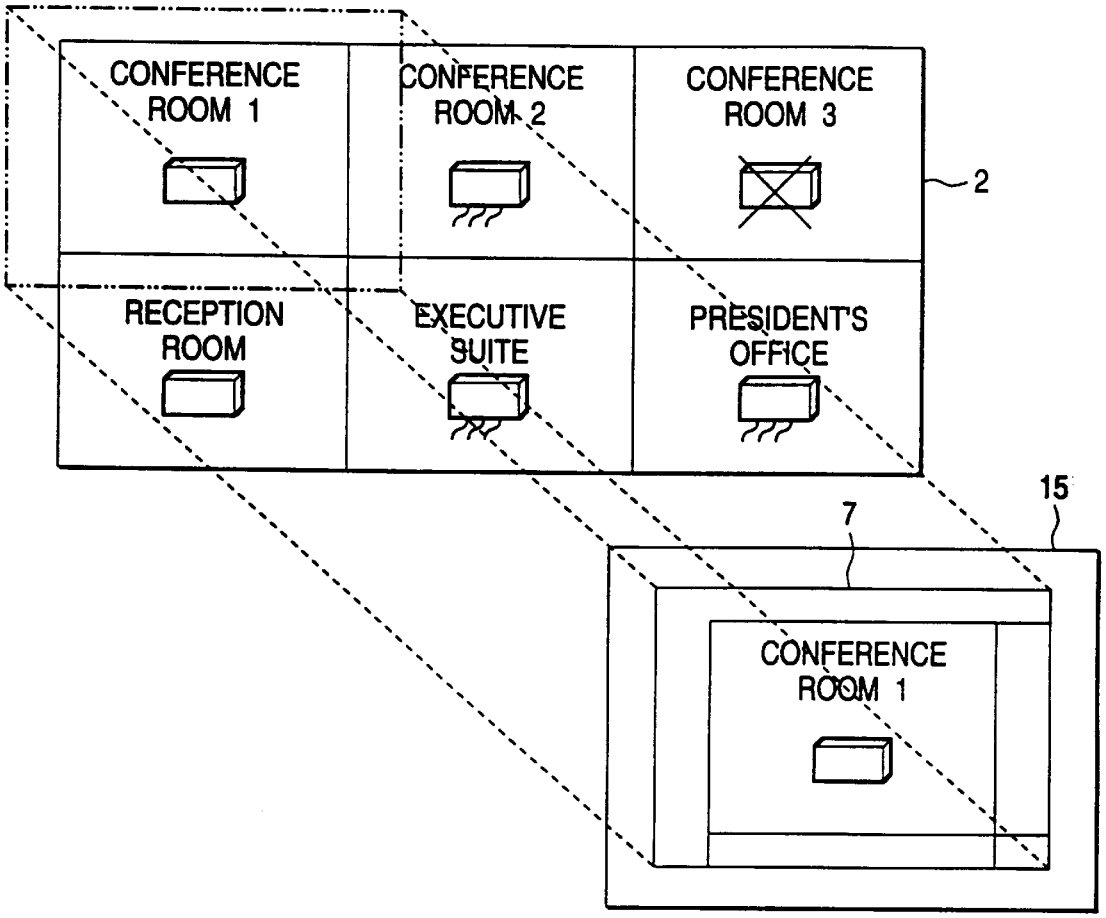
FIG. 7 is a diagram illustrating an example in which a partial image larger than each block of the layout image is displayed on a display.

Next, a description will be given of an example in which an image including the entire desired room and portions of rooms adjacent to that room is displayed on the display 6. In this example, a display 15 of a display size larger than the display size of the display 6 is used, and the other arrangements are identical to those of the apparatus shown in FIG. 1. As shown in FIG. 7, an image centering on the conference room 1 is displayed on the display 15 in the initial state. This display image is an image consisting of the entire conference room 1 as well as portions of the conference room 2 and the reception room. Thus, since potions of the conference room 2 and the reception room are also displayed on the display 15, the operator who viewed this display is able to understand that the display screen can be scrolled rightward and downward.

Figure 8:
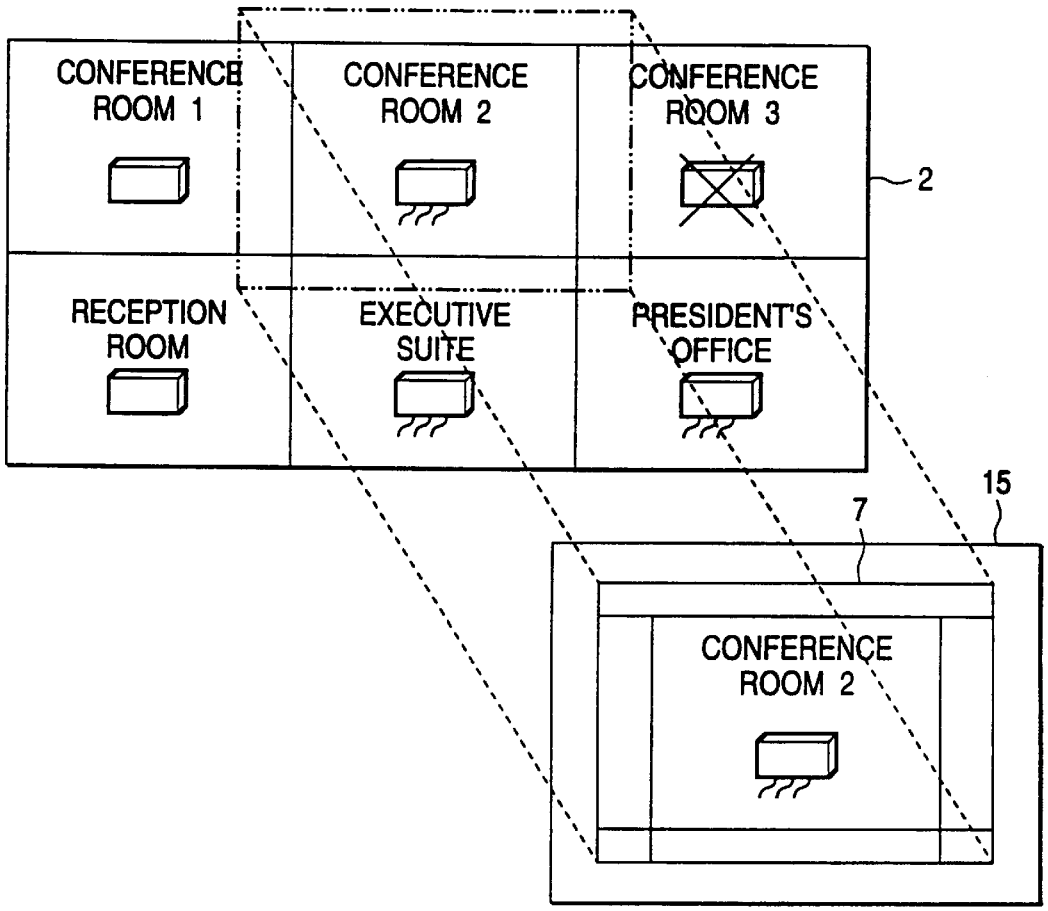
FIG. 8 is a diagram illustrating another example in which a partial image larger than each block of the layout image is displayed on the display.

If the shift information for scrolling rightward is inputted to the input means 9 by the operator, the position of the partial image 7 to be extracted from the layout image 2 is shifted rightward by a one-room portion, and an image centering on the conference room 2 is displayed on the display 15, as shown in FIG. 8. This display image is an image which consists of the entire conference room 2 as well as portions of the conference rooms 1 and 3 and the executive suite. Thus, since the portions of the conference rooms 1 and 3 and the executive suite are also displayed on the display 15, the operator who viewed this display is able to understand that the display of the display 15 can be scrolled rightward, leftward, and downward.

Figure 9:
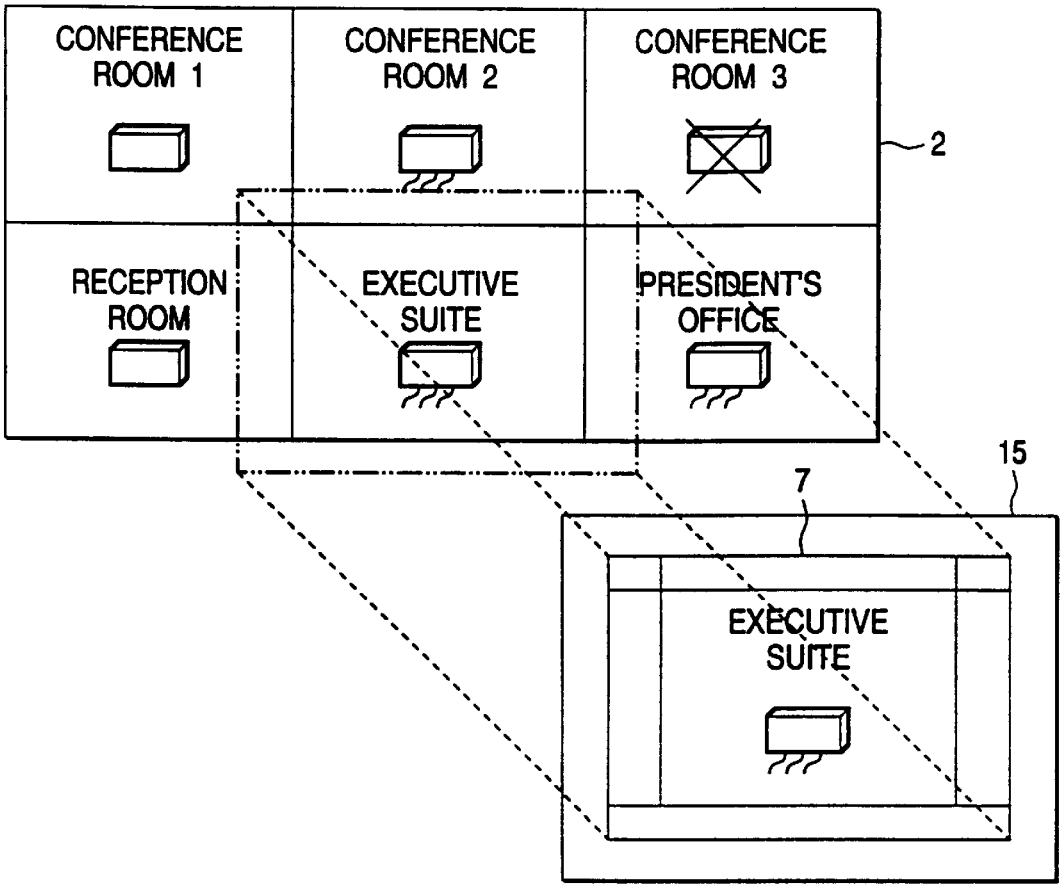
FIG. 9 is a diagram illustrating still another example in which a partial image larger than each block of the layout image is displayed on the display.

Further, in a case where shift information for scrolling downward is inputted to the input means 9 by the operator, the position of the partial image 7 to be extracted from the layout image 2 is shifted downward by a one-room portion, and an image centering on the executive suite is displayed on the display 15, as shown in FIG. 9. This display image is an image which consists of the entire executive suite as well as portions of the conference 2, the reception room, and the president's office. Thus, since the portions of the conference 2, the reception room, and the president's office are also displayed on the display 15, the operator who viewed this display is able to understand that the display on the display 15 can be scrolled rightward, leftward, and upward.

By using the display 15 of a display size larger than the size of each block of the layout image 2 as described above, the operator is able to ascertain at a single glance the directions in which the display on the display 15 can be scrolled.

Figure 10:
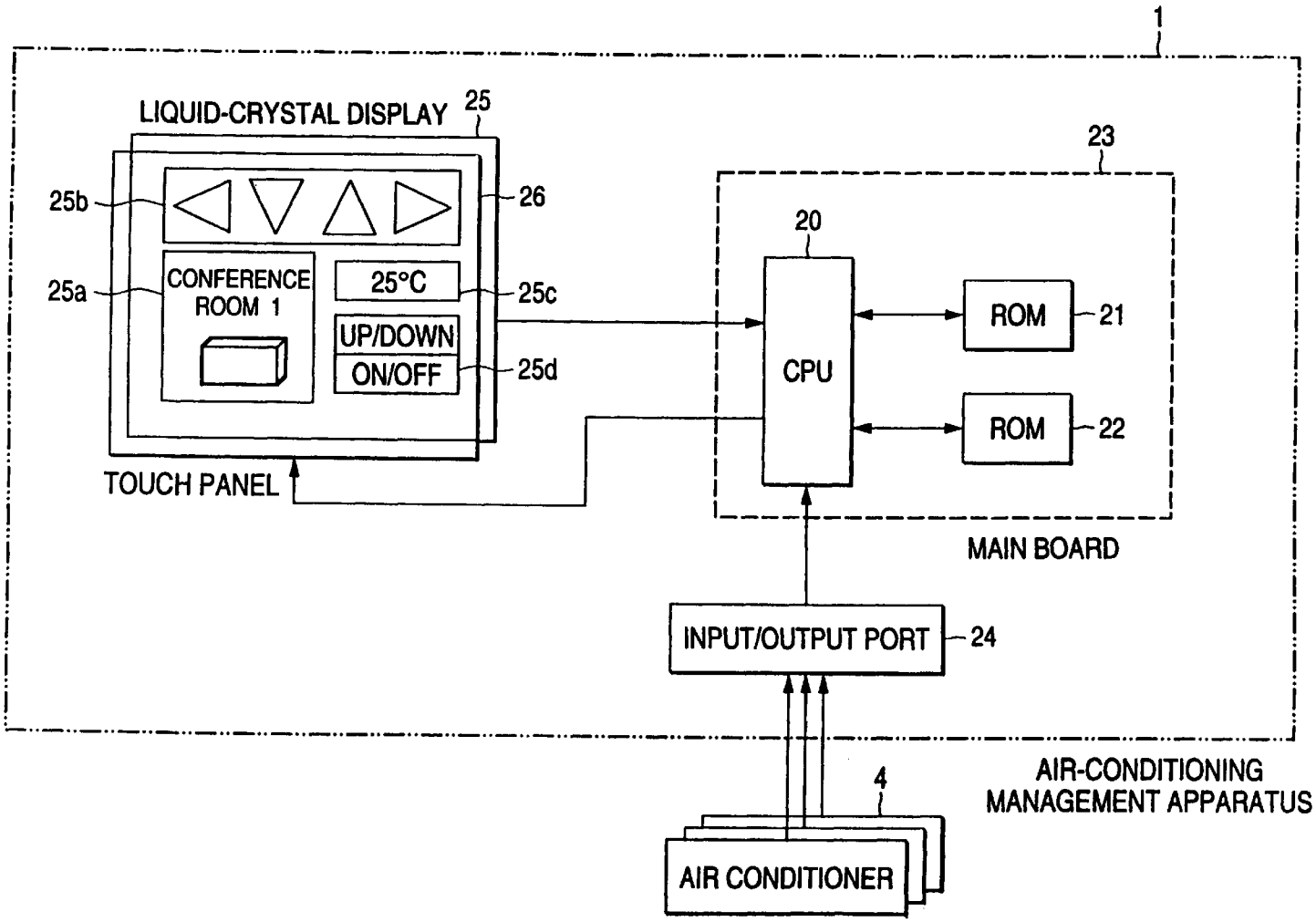
FIG. 10 is a block diagram illustrating a configuration of hardware of the air-conditioning management apparatus in accordance with the first embodiment.

Next, a description will be given of the configuration of the hardware of the air-conditioning management apparatus 1. As shown in FIG. 10, the air-conditioning management apparatus 1 is comprised of a main board 23 on which a CPU 20 and ROMs 21 and 22 are disposed; an input/output port 24 for accepting the operating-state data on the air conditioners 4; a liquid-crystal display 25 for displaying the operating-state data and the like; and a touch panel 26 which is attached to the liquid-crystal display 25 in a superposed manner.

Here, the ROM 21 corresponds to the image storage means 3, and various data including the layout image 2 is stored therein. Meanwhile, processing programs for the image display means 8, the air-conditioning control means 11, and the extracting-position shifting means 10 are stored in the ROM 22. These processing programs are executed under control by the CPU 20. Further, the liquid-crystal display 25 corresponds to the display 6, and the touch panel 26 to the input means 9.

The liquid-crystal display 25 is provided with an area 25*a* for displaying the partial image 7; an area 25*b* for displaying shift switches for allowing the operator to input the shift information; an area 25*c* for displaying the temperature of each room; and an area 25*d* for displaying control switches for inputting the control information for controlling the respective air conditioners 4. Four arrow buttons corresponding to the respective directions are used as the shift switches. In addition, as the control switches, an UP/DOWN button for changing the set temperatures of the air conditioners 4 and an ON/OFF button for the on/off control of the air conditioners 4 are used.

In addition, as the operator depresses such as the arrow button displayed in the area 25*b* or the UP/DOWN button displayed in the area 25*d*, the shift information or control information is inputted through the touch panel 26. Such information is imparted to the CPU 20, and the processing in the above-described Steps 101 to 106 is executed.

It should be noted that various other switches, including a joystick, a pushbutton switch, and a trackball, may be used instead of the touch panel 26. In addition, the shifting direction may be changed sequentially by pressing a single pushbutton switch a plurality of times.

Second Embodiment

Figure 11:
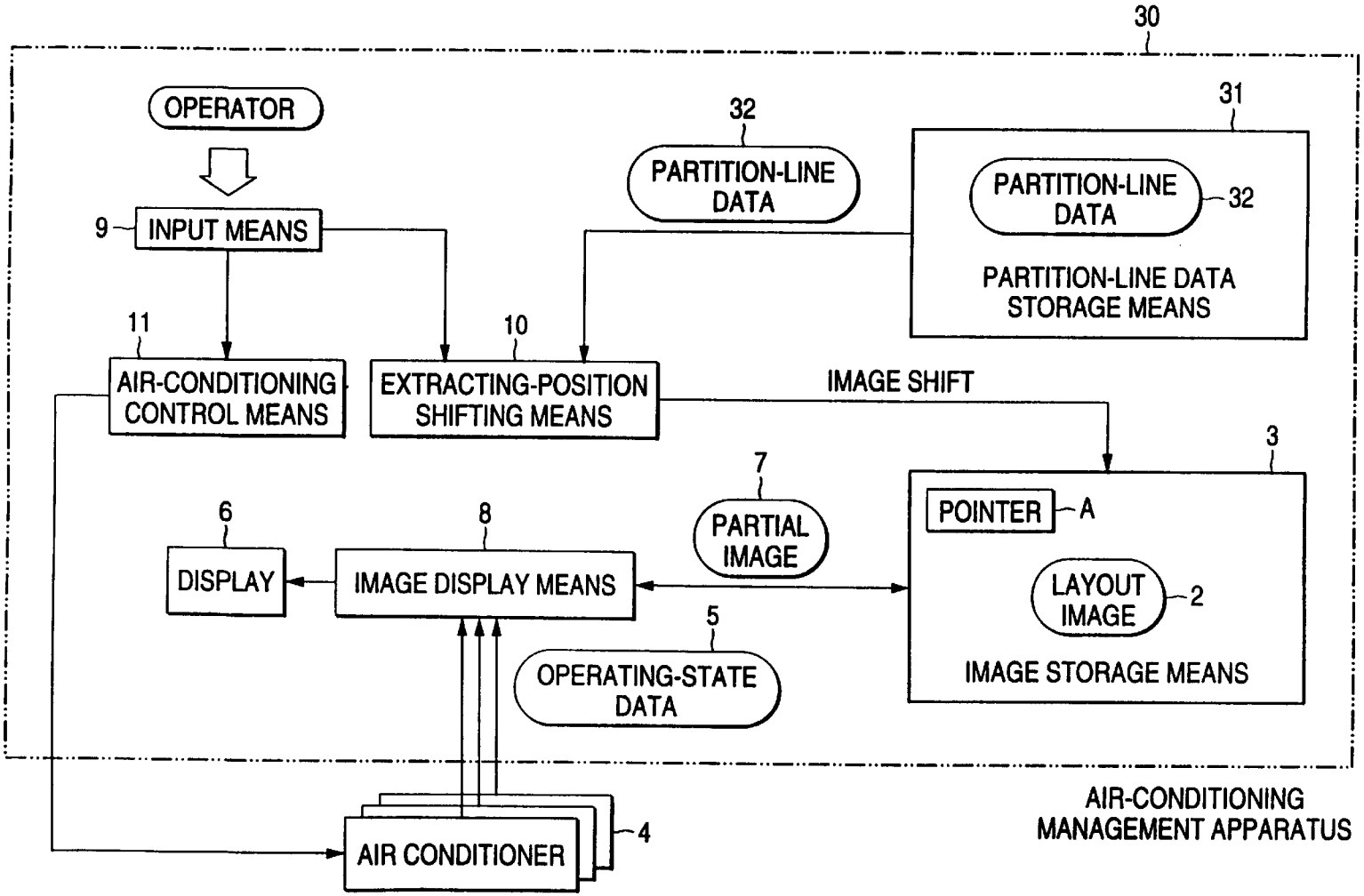
FIG. 11 is a block diagram illustrating an air-conditioning management apparatus in accordance with a second embodiment.

Next, a description will be given of an air-conditioning management apparatus in accordance with a second embodiment. FIG. 11 is a block diagram illustrating an air-conditioning management apparatus 30 in accordance with the second embodiment. This second embodiment differs from the first embodiment shown in FIG. 1 only in that a partition-line-data storage means 31 is provided. The other arrangements are identical or equivalent to those of the first embodiment. It should be noted that those constituent portions that are identical or equivalent to those of the first embodiment will be denoted by the same reference numerals, and a description thereof will be omitted.

As shown in FIG. 11, the air-conditioning management apparatus 30 is provided with the partition-line-data storage means 31 in which a plurality of pieces of partition-line data 32 for partitioning the floor into rooms are stored. The partition-line data is segment data for partitioning the layout image 2 into a plurality of blocks, and is stored as coordinate data on the layout image 2. For example, partition-line data 32*a* on the partition line 12 shown in FIG. 2 is (0–639, 240), and partition-line data 32*b* on the partition line 13 shown in FIG. 2 is (213, 0–479). Further, partition-line data 32*c* on the partition line 14 is (426, 0–479).

Figure 12:
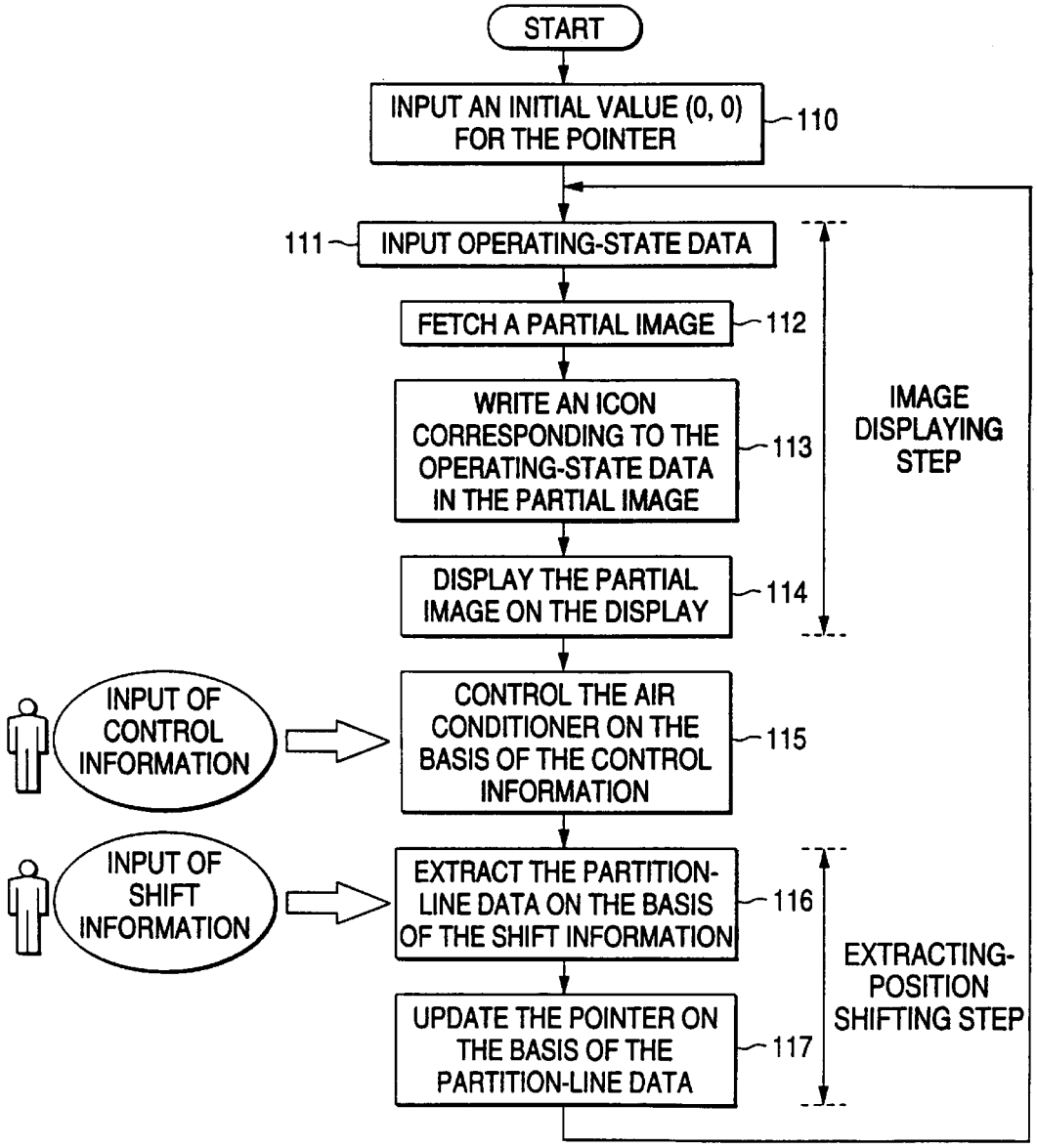
FIG. 12 is a flowchart illustrating the operation of the air-conditioning management apparatus in accordance with the second embodiment.

Next, the operation of the air-conditioning management apparatus 30 will be described with reference to the flowchart shown in FIG. 12. First, an initial value address (0, 0) is set for the pointer A for accessing the image storage means (Step 110). Then, the plurality of pieces of operating-state data 5 sent from the respective air conditioners 4 are imparted to the image display means 8 (Step 111). Further, the partial image 7, which is a partial image of the layout image 2, is extracted from the image storage means 3 and is imparted to the image display means 8 (Step 112).

As a result, the operating-state data 5 and the partial image 7 are inputted to the image display means 8, as shown in FIG. 4. The image display means 8 checks the operating-state data 5 of the air conditioner 4 in the conference room 1 corresponding to the partial image 7, and writes an icon corresponding to this operating state in a lower portion of the partial image 7 (Step 113). The operating-state data 5 is data which represents the operating states of the air conditioners 4 by numerals, wherein "0" denotes that the air conditioner is being stopped, "1" denotes that the air conditioner is operating, and "2" denotes that the air conditioner is out of order. Then, as shown in FIG. 5, an icon corresponding to the operating-state data 5 is selected from among the three kinds prepared according to these operating states.

Subsequently, the partial image 7 where the icon is written is displayed on the display 6 (Step 114), so that the operator is capable of ascertaining the operating state of the air conditioner 4 installed in the conference room 1. Namely, from the display on the display 6 shown in FIG. 4, the operator is able to understand that the air conditioner 4 in the conference room 1 is being stopped. Then, if the operator who viewed the display on the display 6 inputted the control information for starting the air conditioner 4 to the input means 9, this control information is imparted to the air-conditioning control means 11. This control information is transmitted to the air conditioner 4, which in turn starts operation on the basis of the control information. In addition, the operator is also able to input control information for changing the set temperature for the air conditioner 4. This control information is also transmitted to the air conditioner 4 via the air-conditioning control means 11, and the set temperature for the air conditioner 4 is changed on the basis of the control information (Step 115).

Next, if the operator inputted shift information to the input means 9 to allow the operating state of the air conditioner 4 in another room to be displayed on the display 6, this shift information is imparted to the extracting-position shifting means 10. In the extracting-position shifting means 10, the shifting direction is detected of the basis of this shift information, and the partition-line data 32 which has the shortest distance in the shifting direction with respect to the present position of the pointer is extracted from the partition-line-data storage means 31 (Step 116). Then, a point of intersection between a segment extending from the present position of the pointer in the shifting direction and a partition line indicated by the partition-line data 32 is set as a new position of the pointer (Step 117).

Specifically, in a case where the shift information is an instruction for rightwardly scrolling the display screen of the display 6, if it is assumed that the present address of the pointer A is (0, 0) in FIG. 2, the partition-line data 32 which has the shortest distance in the rightward direction with respect to the pointer A (0, 0) is selected from among the three pieces of partition-line data 32*a* to 32*c* stored in the partition-line-data storage means 31. Then, the partition-line data 32*b* (213, 0–479) is extracted as a result of this selection. Further, a point of intersection (213, 0) between the segment 15 extending from pointer A (0, 0) in the rightward direction and the partition line 13 indicated by the partition-line data 32*b* is detected, and this point of intersection is set as a new position of the pointer. As a result, the new address of the pointer A becomes (213, 0). Subsequently, the processing returns to Step 101 to impart the operating-state data 5 to the image display means 8.

Next, the processing in Step 102 is executed to extract the partial image 7 from the image storage means 3, and this partial image 7 is imparted to the image display means 8. Since the address of the pointer A here is (213, 0), an area which is formed by 213th to 426th dots in the direction of the horizontal axis and 0th to 240th dots in the direction of the vertical axis is extracted as the partial image 7. Then, the processing in Steps 103 and 104 is executed to write the icon in the partial image 7 and display the same on the display 6. From this display, the operator is able to understand that the air conditioner 4 installed in the conference room 2 is being presently operated. Subsequently, as the operator inputs control information or shift information, the processing in Steps 105 and 106 is executed to effect the control of the air conditioner 4 and the like.

Since the position of the partial image 7 to be extracted is shifted in units of rooms in the above-described manner, the display screen can be scrolled simply to the targeted partial image 7 with a small number of operations, and the operating state of the air conditioner 4 in each room can be ascertained speedily without exception. In addition, since the new address of the pointer A is extracted on the basis of the partition-line data 32 provided separately from the layout image 2, the processing speed for updating the address improves.

It should be noted that the processing in Steps 111 to 114 corresponds to the step of displaying an image in which the partial image 7 with the operating-state data 5 added thereto is displayed on the display 6. In addition, the processing in Steps 116 and 117 correspond to the step of shifting an extracting position in which the partial image 7 is shifted in units of rooms.

Further, it is possible to use the display 15 having a larger display size instead of the display 6. In this case, as shown in FIGS. 7 to 9, an image including the desired entire room and portions of rooms adjacent to that room is displayed on the display 15, and it is possible to easily ascertain the directions in which the screen can be scrolled.

Third Embodiment

Figure 13:
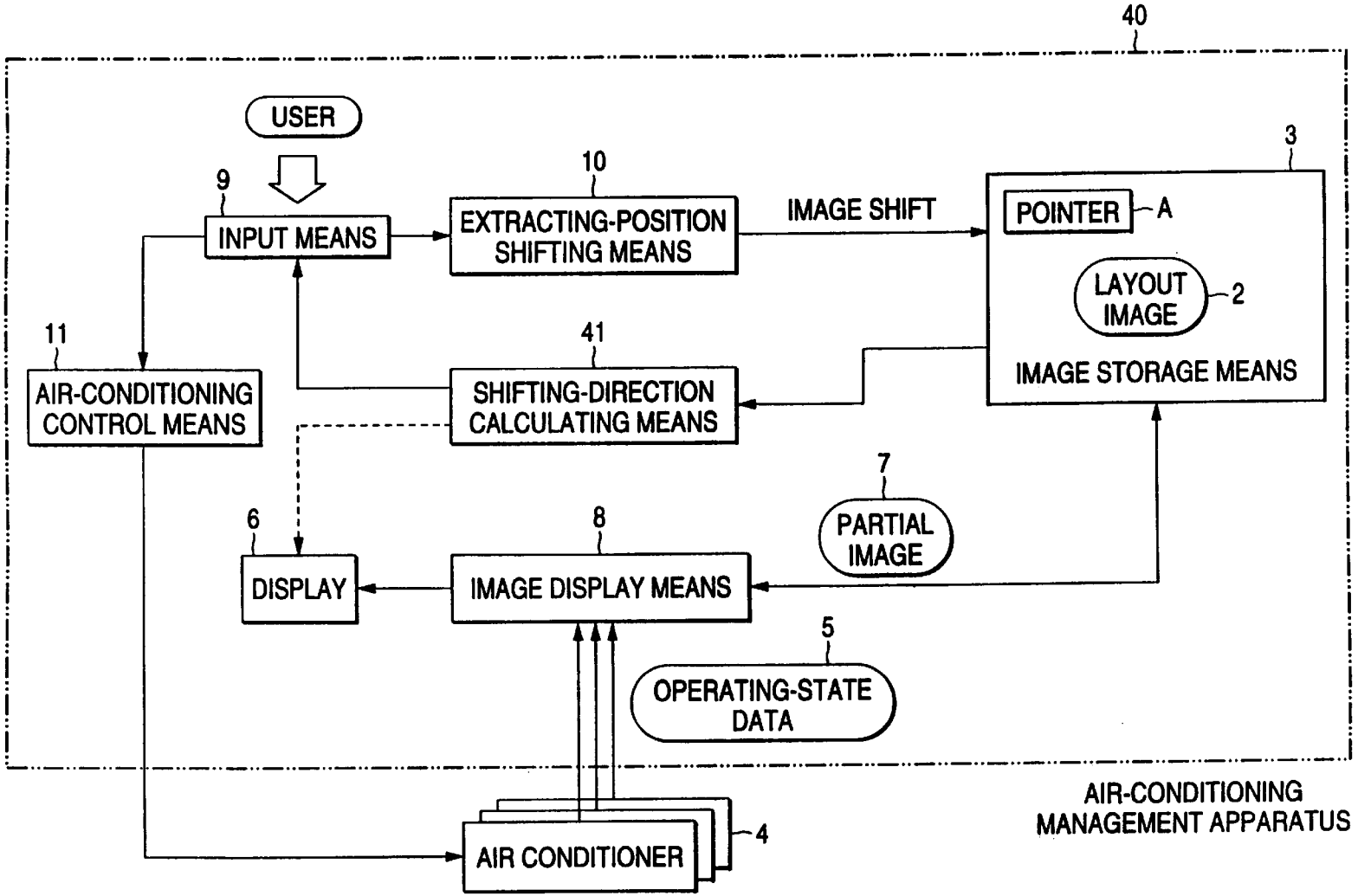
FIG. 13 is a block diagram illustrating an air-conditioning management apparatus in accordance with a third embodiment.

Next, a description will be given of an air-conditioning management apparatus in accordance with a third embodiment. FIG. 13 is a block diagram illustrating an air-conditioning management apparatus 40 in accordance with the third embodiment. This third embodiment differs from the first embodiment shown in FIG. 1 only in that a shifting-direction calculating means 41 is provided. The other arrangements are identical or equivalent to those of the first embodiment. It should be noted that those constituent portions that are identical or equivalent to those of the first embodiment will be denoted by the same reference numerals, and a description thereof will be omitted.

As shown in FIG. 13, the air-conditioning management apparatus 40 is provided with the shifting-direction calculating means 41 for calculating the directions in which the position of the partial image 7 to be extracted from the layout image 2 can be shifted, by inputting the address of the pointer A stored in the image storage means 3. The result of calculation by the shifting-direction calculating means 41 is imparted to the input means 9, and control is provided in such a manner as to nullify inputs of shift information on shifting in directions in which the extracting position cannot be shifted by the input means 9. Meanwhile, in a case where directions in which the extracting position can be shifted are displayed on the display 6 by means of such as arrows, the result of calculation by the shifting-direction calculating means 41 is imparted to the display 6 as well, and the details of display on the display 6 are changed.

Figure 14:
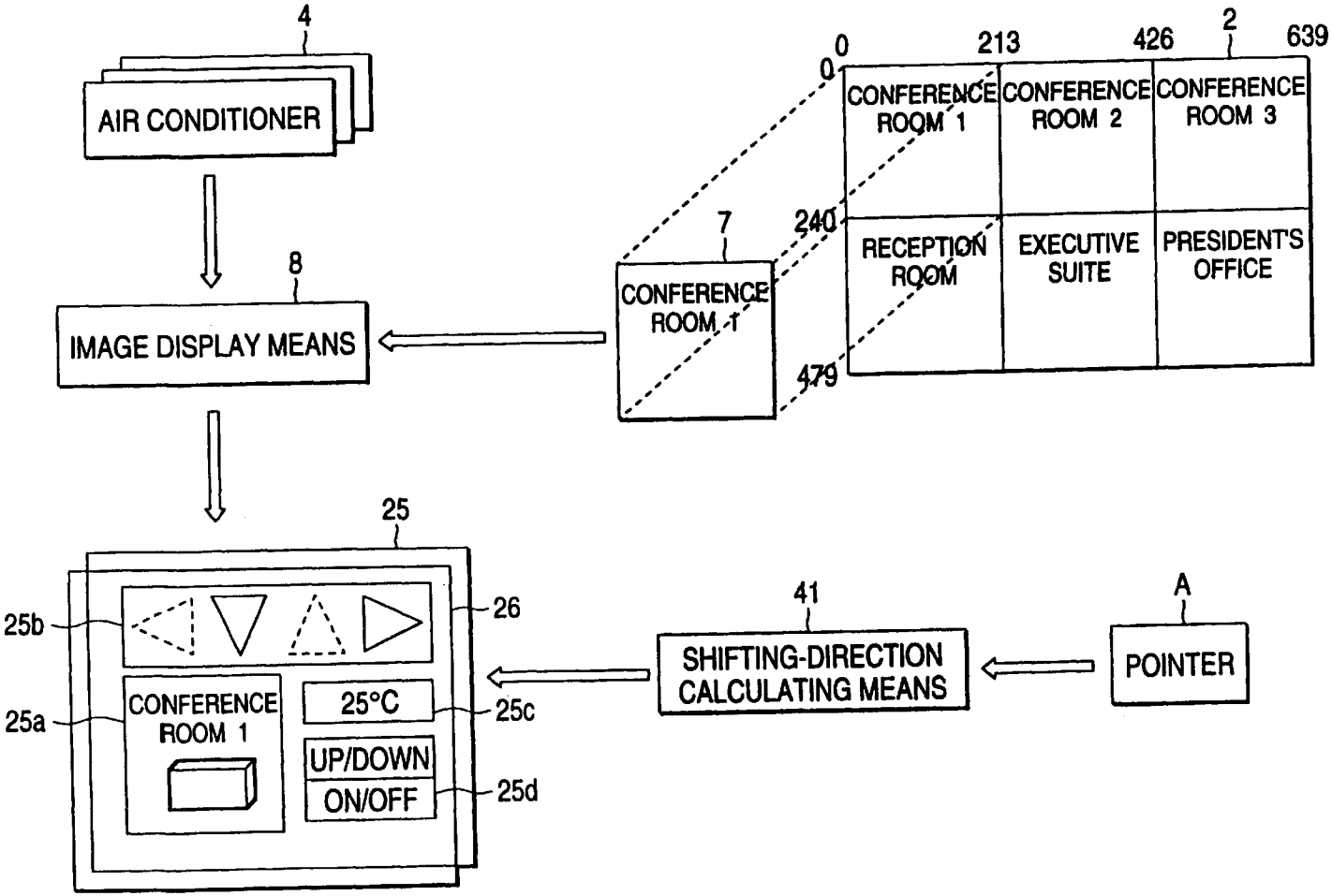
FIG. 14 is a diagram illustrating an example of shift switches displayed on the display.

For example, in a case where the liquid-crystal display 25 is used as the display 6 and the touch panel 26 as the input means 9 as shown in FIG. 14, some of the four arrow buttons (shift switches) are displayed in the area 25*b* of the liquid-crystal display 25. Here, in a case where the partial image 7 displayed in the area 25*a* of the liquid-crystal display 25 is an image of the conference room 1 located at the upper left end of the layout image 2, the address (0, 0) is set for the pointer A.

The shifting-direction calculating means 41 calculates the addresses of apices of the partial image 7 on the basis of this address of the pointer A, and obtains (0, 0), (213, 0), (0, 240), and (213, 240). Further, the layout image 2 has an area of 640 bits in the horizontal direction and 480 bits in the vertical direction, and the partial image 7 is capable of moving in the range of (0, 0) to (639, 479).

Because the apex (0, 0) of the partial image 7 is at the upper left end of the layout image 2, the shifting-direction calculating means 41 judges that the position of the partial image 7 to be extracted from the layout image 2 cannot be shifted leftward and upward. Further, because the apex (213, 240) of the partial image 7 is in a central portion of the layout image 2, the shifting-direction calculating means 41 judges that the position of the partial image 7 to be extracted from the layout image 2 can be shifted rightward and downward.

The shifting-direction calculating means 41 imparts the shiftable directions thus obtained to the liquid-crystal display 25 and the touch panel 26, and deletes the display of the rightward and upward arrow buttons in the area 25*b* of the liquid-crystal display 25. In addition, the shifting-direction calculating means 41 nullifies the input at the positions of the rightward and upward arrow buttons on the touch panel 26.

Figure 15:
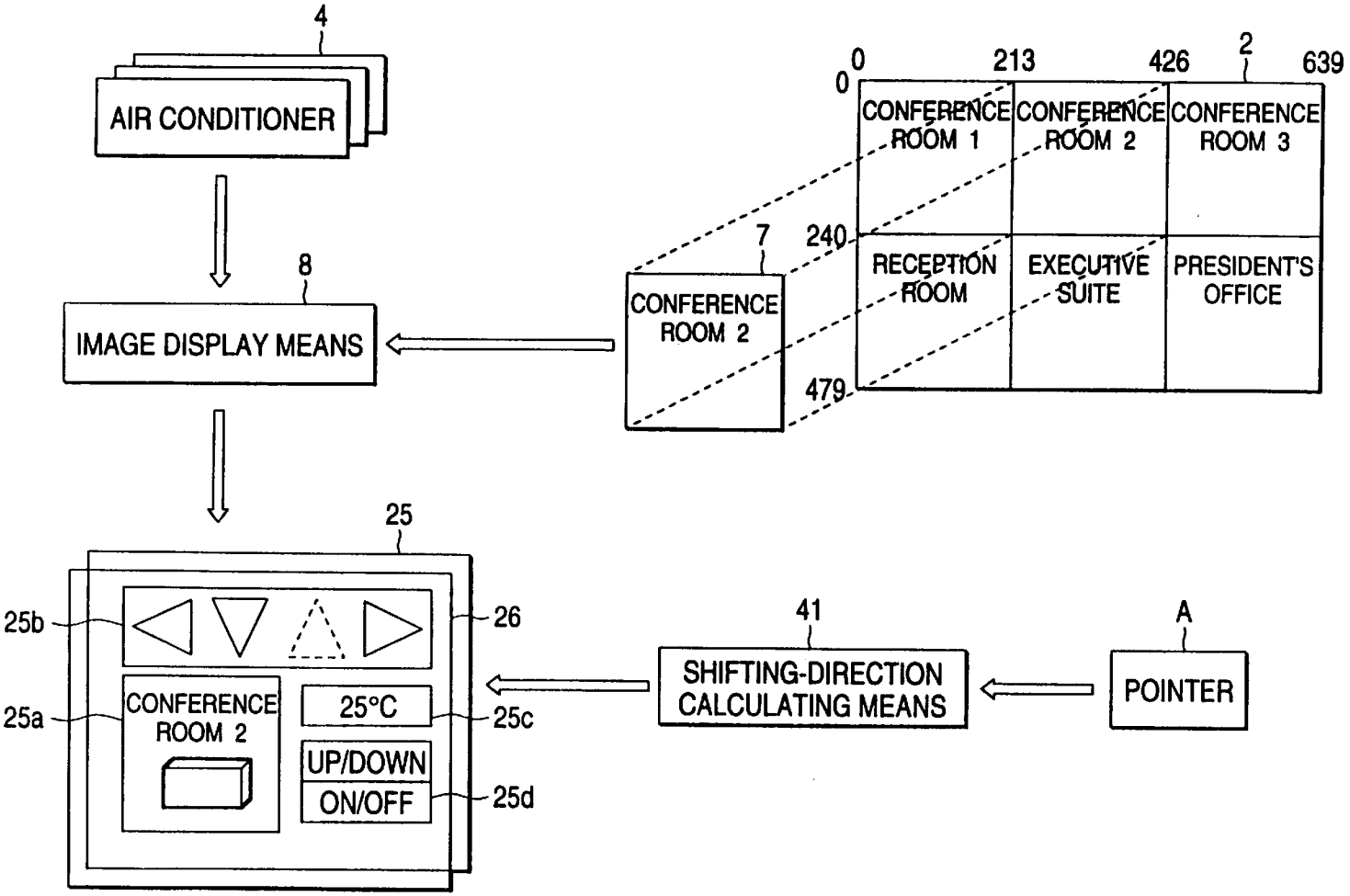
FIG. 15 is a diagram illustrating another example of shift switches displayed on the display.

Next, in a case where the shift information for scrolling rightward is inputted by the operator, the partial image 7 whose position is shifted rightward by a one-room portion is extracted from the layout image 2, and is displayed in the area 25*a* of the liquid-crystal display 25, as shown in FIG. 15. It is assumed that (213, 0) is set for the pointer A at that time. This address of the pointer A is imparted to the shifting-direction calculating means 41, which effects the above-described comparison and calculation of the addresses to calculate shiftable directions.

Namely, the shifting-direction calculating means 41 calculates the addresses of apices of the partial image 7 on the basis of the address of the pointer A, and obtains (213, 0), (426, 0), (213, 240), and (426, 240). Because the apices (213, 0) and (426, 0) of the partial image 7 are at the upper end of the layout image 2, the shifting-direction calculating means 41 judges that the position of the partial image 7 to be extracted from the layout image 2 cannot be shifted upward. Further, because the apices (213, 240) and (426, 240) of the partial image 7 are in a central portion of the layout image 2, the shifting-direction calculating means 41 judges that the position of the partial image 7 to be extracted from the layout image 2 can be shifted rightward, leftward, and downward.

The shifting-direction calculating means 41 imparts the shiftable directions thus obtained to the liquid-crystal display 25 and the touch panel 26, and deletes the display of the upward arrow button in the area 25*b* of the liquid-crystal display 25. In addition, the shifting-direction calculating means 41 nullifies the input at the position of the upward arrow button on the touch panel 26.

Since the display of arrow buttons in the directions in which the position of the partial image 7 to be extracted from the layout image 2 cannot be shifted is deleted in the above-described manner, the operator is able to visually judge the shiftable directions, with the result that it is possible to obtain a highly reliable air-conditioning management apparatus in which erroneous operations are difficult to occur.

It should be noted that, in a case where pushbutton switches or the like are used instead of the touch panel 26, images indicating shiftable directions may be displayed on the display of the liquid-crystal display 25 or the like. For instance, arrow-shaped marks such as those described above may be used, and a framing line (in particular, a color display in such as red or green is effective) may be displayed at an edge portion on the shiftable side on the display.

Fourth Embodiment

Figure 16:
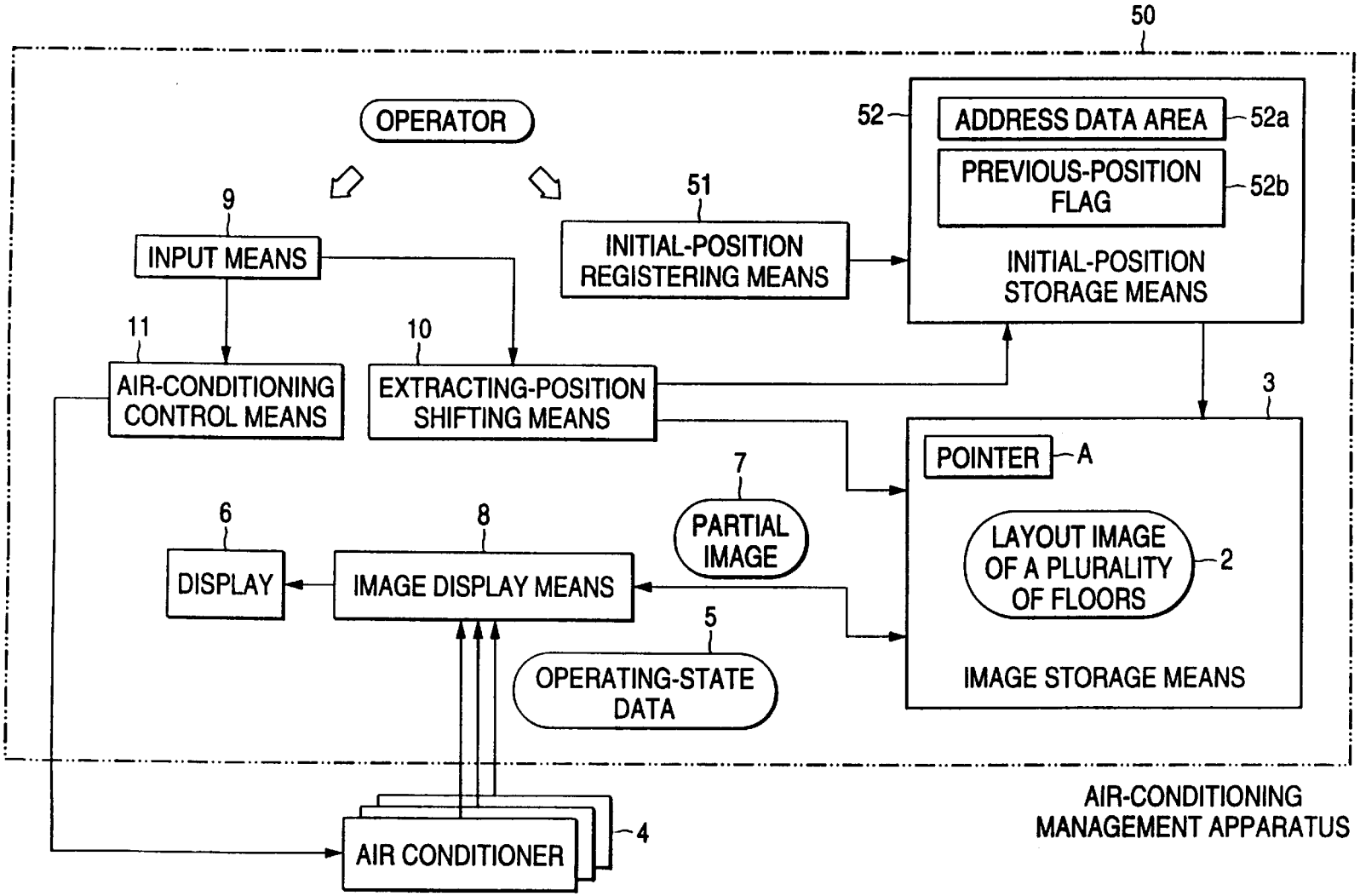
FIG. 16 is a block diagram illustrating an air-conditioning management apparatus in accordance with a fourth embodiment.

Next, a description will be given of an air-conditioning management apparatus in accordance with a fourth embodiment. FIG. 16 is a block diagram illustrating an air-conditioning management apparatus 50 in accordance with the fourth embodiment. This fourth embodiment differs from the first embodiment shown in FIG. 1 only in that layout images 2 of a plurality of floors are stored in the image storage means 3, in that an initial-position registering means 51 and an initial-position storage means 52 are provided, and in that the input of selection of a floor is accepted by the input means 9.

Thus, since layout images 2 of a plurality of floors are stored in the image storage means 3, the air conditioners 4 installed on the respective floors as in a building can be managed by a single air-conditioning management apparatus 50 on a centralized basis. In addition, since the input of selection of a floor is accepted by the input means 9, it is possible to display the layout image 2 of a desired floor on the display 6.

It should be noted that since the arrangements other those described above are identical or equivalent to those of the first embodiment, those constituent portions that are identical or equivalent to those of the first embodiment will be denoted by the same reference numerals, and a description thereof will be omitted.

As shown in FIG. 16, the air-conditioning management apparatus 50 is provided with the initial-position registering means 51 for registering an initial position at a time when the partial image 7 is extracted from the layout image 2, as well as the initial-position storage means 52 for storing for each floor the address of the initial position registered by the initial-position registering means 51. Data on the initial position which can be registered in the initial-position registering means 51 includes, for instance, "north, northeast, northwest, east, west, center, southeast, southwest, south, and previous display position. The initial-position registering means 51 is provided with an input portion (e.g., pushbutton switches) for entering these items of data. In addition, in the initial-position storage means 52, an address data area 52*a* for storing the address of the initial position as well as a previous-position flag 52*b* indicating the registration of the "previous display position" are provided for each floor.

If the data on the initial position is inputted by the operator, the initial-position registering means 51 converts the inputted data into address data, and this address data is stored in the address data area 52*a* of the initial-position storage means 52. The address data is the address data on the layout image 2. For example, "north" is converted to the address (213, 0); "northeast" to the address (426, 0); "northeast" to the address (0, 0); and "south" to the address (213, 240). The address data thus converted is stored in the address data area 52*a* of the initial-position storage means 52.

In addition, if the "previous display position" is inputted by the operator, the initial-position registering means 51 sets the previous-position flag 52*b* of the initial-position storage means 52. While the previous-position flag 52*b* is on, the address data inputted from the extracting-position shifting means 10 is accepted, and the address data area 52*a* of the initial-position storage means 52 is updated by this address data. As a result, the address of the previous display position is always stored in the address data area 52*a* of the initial-position storage means 52.

Figure 17:
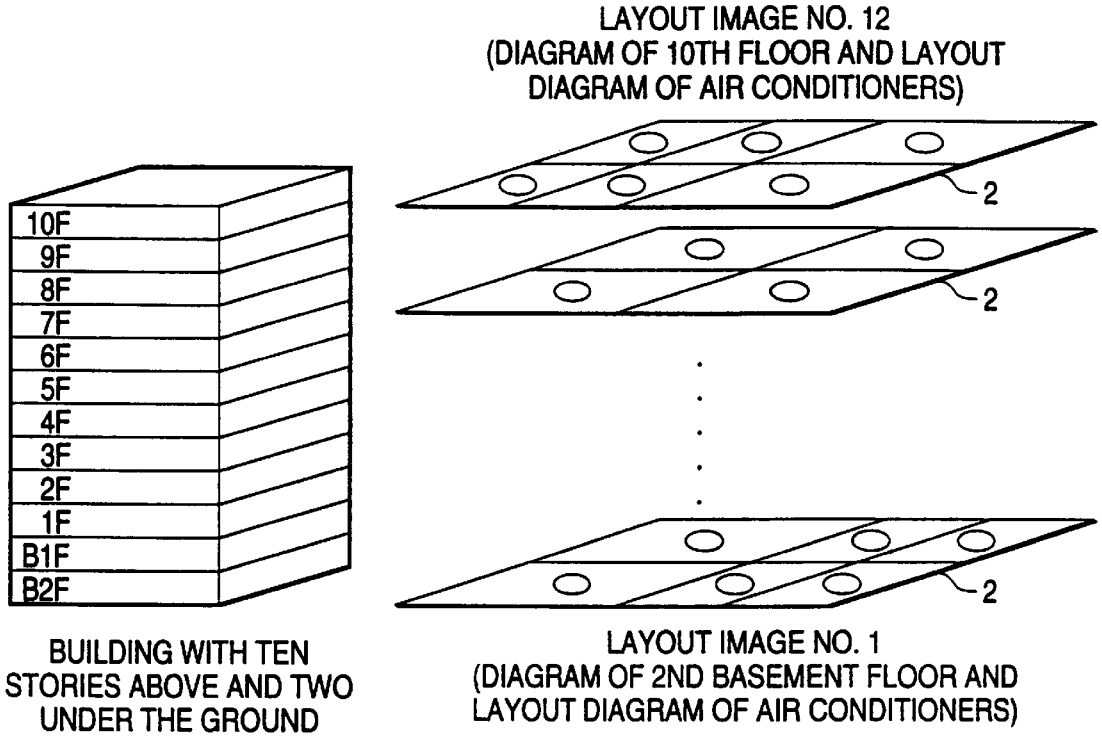
FIG. 17 is a diagram illustrating the relationship between each floor of a building and the layout image.

As shown in FIG. 17, in a case where, for example, a building with ten stories above and two under the ground is managed by the air-conditioning management apparatus 50, twelve layout images 2 are stored in the image storage means 3. Then, the selection of the layout image 2 displayed on the display 6 is effected by designating the number of the floor by the input means 9. When the desired layout image 2 is selected by this designation, the address data corresponding to the layout image 2 is read from the address data area 52*a* of the initial-position storage means 52, and this address data is set for the pointer A of the image storage means 3.

Next, the image storage means 3 is accessed, and the partial image 7 for which the pointer A is set as the starting point is extracted from the desired layout image 2. Here, if the address of the position of the room where the air conditioner 4 having a high frequency of operation is installed is registered in advance in the initial-position storage means 52 as the initial position, when the layout image 2 is changed over, the partial image 7 centering on the room where the air conditioner 4 is installed can be displayed on the display 6. In addition, if the previous-position flag 52*b* of the initial-position storage means 52 is set in advance, when the layout image 2 is changed over, the partial image 7 which was displayed previously can be displayed on the display 6.

Figure 18:
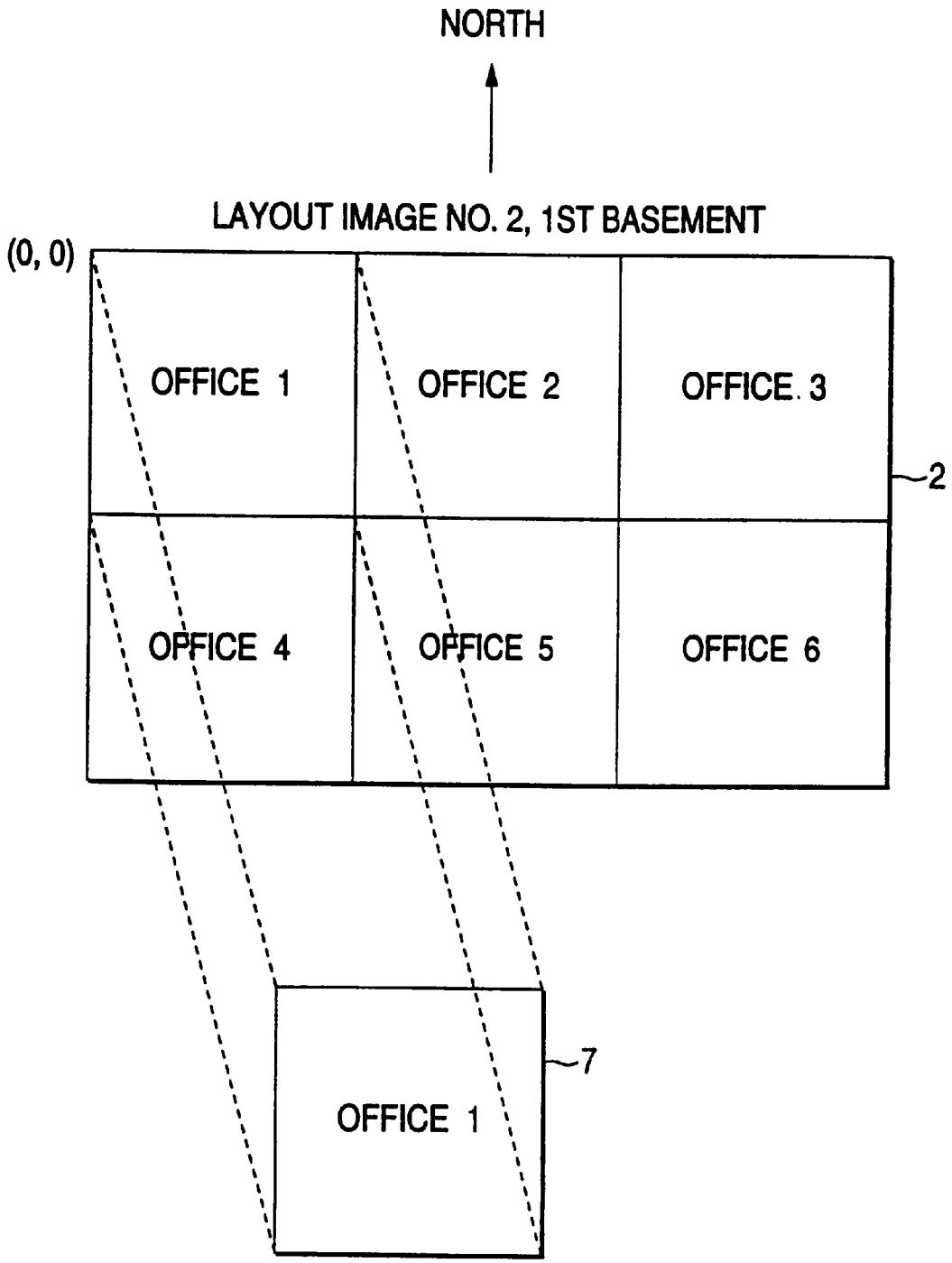
FIG. 18 is a diagram illustrating the relationship between the layout image and the partial image.

Specifically, if the layout image 2 of the first basement is selected, the address (0, 0) is read from the address data area 52*a*, and this address is set for the pointer A of the image storage means 3. Then, in a case where "northwest" has been inputted with respect to the layout image 2 of the second basement, the address (426, 240) has been stored in the address data area 52*a* corresponding to this layout image 2. As a result, as shown in FIG. 18, the partial image 7 of an "office 1" having the address (0, 0) as the starting point is extracted from the layout image 2 of the first basement.

Figure 19:
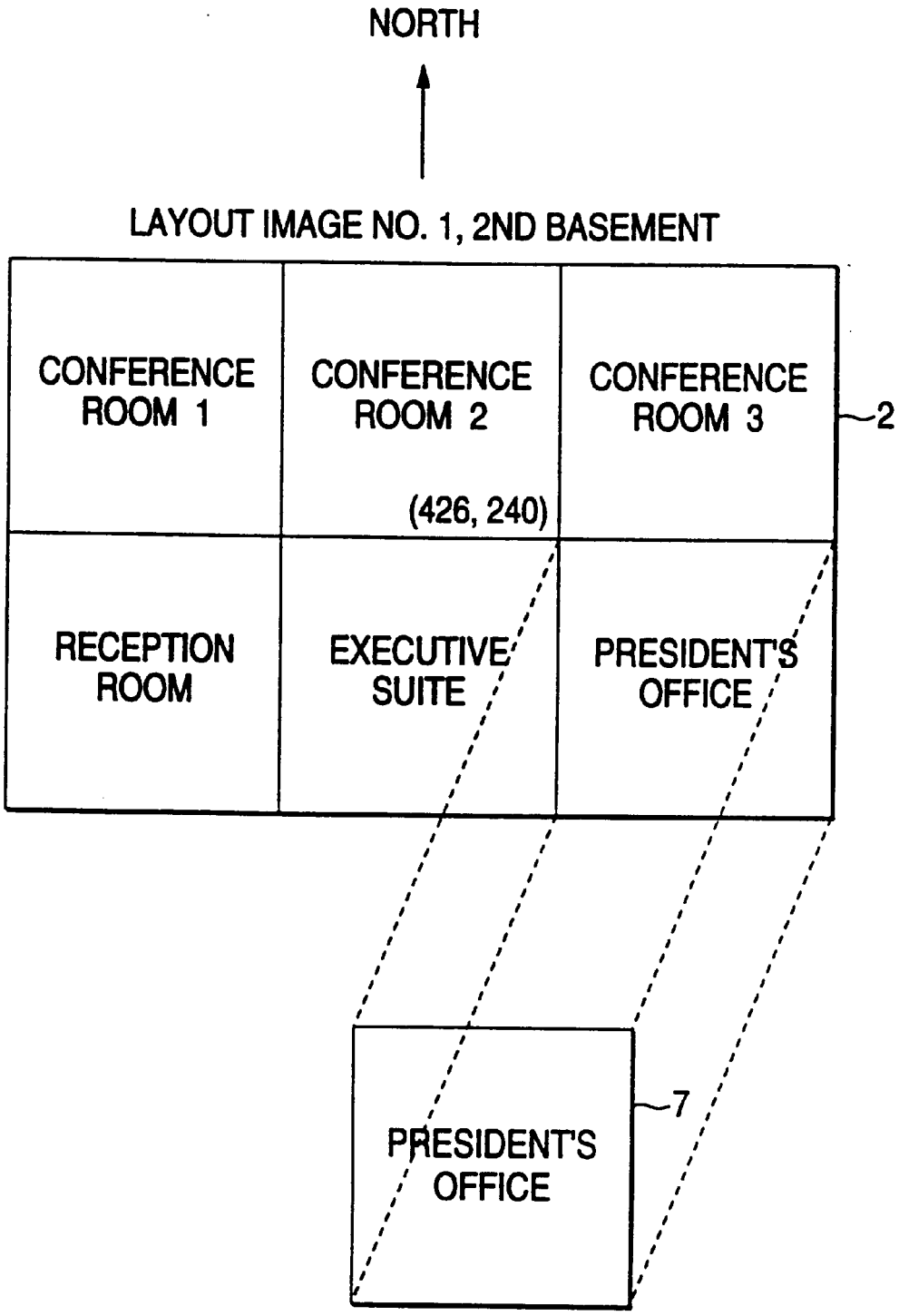
FIG. 19 is a diagram illustrating the relationship between the layout image and the partial image.

Next, if the layout image 2 of the second basement is selected, the address (426, 240) is read from the address data area 52*a*, and this address is set for the pointer A of the image storage means 3. As a result, the partial image 7 of the "president's office" having the address (426, 240) as the starting point is extracted from the layout image 2 of the second basement, as shown in FIG. 19.

As described above, when the layout image 2 is changed over, the partial image 7 which is first displayed on the display 6 can be registered in accordance with the intention of the operator, so that the partial image 7 of the room where the air conditioner 4 having a high frequency of operation is installed can be displayed first on the display 6. Consequently, the operational efficiency of the apparatus improves, and the plurality of air conditioners 4 can be operated in a short time.

It should be noted that the present invention is not limited to the above-described embodiments, and may be modified as described below within a range that does not deviate from the gist of the present invention.

(1) Although, in the above-described first to fourth embodiments, the partial image 7 in which the address of the pointer A is set at the upper left end is extracted from the layout image 2, the address of the pointer A may be set at another position such as the upper right end or the lower left end without being confined to the upper left end, so as to extract the partial image 7 from the layout image 2.

(2) Although, in the above-described first to third embodiments, (0, 0) is set as the initial value of the pointer A, an initial value stored in the initial-position storage means 52 may be set for the pointer A as in the fourth embodiment.

(3) Although, in the above-described first to fourth embodiments, the layout image 2 which is 640 dots wide by 480 dots high is partitioned into six blocks to correspond to the respective rooms, it is possible to use the layout image 2 of a size other than the same, and the number of partitions is not limited to six and may be other than six.

(4) By combining the above-described second and third embodiments, both the partition-line-data storage means 31 and the shifting-direction calculating means 41 may be provided. In addition, by combining the above-described second and fourth embodiments, the partition-line-data storage means 31, the initial-position registering means 51, and the initial-position storage means 52 may be provided.

Further, by combining the above-described third and fourth embodiments, the shifting-direction calculating means 41, the initial-position registering means 51, and the initial-position storage means 52 may be provided. Furthermore, by combining the above-described second to fourth embodiments, the data storage means 31, the shifting-direction calculating means 41, the initial-position registering means 51, and the initial-position storage means 52 may be provided.

INDUSTRIAL APPLICABILITY

As described above, the method of displaying air-conditioning management information and the air-conditioning management apparatus in accordance with the present invention make it possible to display with a fewer number of operations the operating states of air conditioners disposed respectively in a plurality of rooms. Accordingly, the method of displaying air-conditioning management information and the air-conditioning management apparatus in accordance with the present invention are suitable for collectively managing a multiplicity of air conditioners.

What is claimed is:

1. A method of displaying air-conditioning management information, comprising the steps of:

selecting an extracting position corresponding to a specific room for a layout image of a floor having a plurality of rooms;

displaying a partial image extracted from the layout image of the floor having the plurality of rooms, said partial image showing the specific room at the extracting position together with operating-state data on at least one air conditioner assigned to the specific room; and shifting the extracting position in units of rooms.

2. An air-conditioning management apparatus for managing a plurality of air conditioners on a centralized basis by displaying on a display data on operating states of air conditioners assigned to each room on a floor, comprising:

an image storage device in which a layout image of the floor having a plurality of rooms is stored;

an image display extracting device configured to select an extracting position and extract from the layout image a partial image based on the extracting position and corresponding to a specific room;

an image display device configured to display on said display the partial image at the extracting position together with operating-state data on at least one of said air conditioners assigned to each room; and an extracting-position shifting device configured to shift in units of rooms the extracting position of the partial image to be extracted from the layout image.

3. An air-conditioning management apparatus according to claim 2, further comprising:

a partition-line-data storage device in which partition-line data configured to partition the floor into rooms is stored, wherein said extracting-position shifting device shifts in units of rooms the position of the partial image to be extracted from the layout image on the basis of the partition-line data read from said partition-line-data storage device.

4. An air-conditioning management apparatus according to claim 2, wherein the partial image comprises an image including an entire desired room and portions of rooms adjacent to the desired room.

5. An air-conditioning management apparatus according to claim 2, further comprising:

shift switches each adapted to specify a shifting direction at a time when the position of the partial image to be extracted is shifted by said extracting-position shifting device, wherein said shift switches nullifies inputs with respect to unshiftable directions.

6. An air-conditioning management apparatus according to claim 5, wherein said shift switches comprise arrow buttons for various directions displayed on a touch panel, and only the arrow buttons in shiftable directions are displayed.

7. An air-conditioning management apparatus according to claim 2, wherein layout images concerning a plurality of floors are stored in said image storage device, and said image display device displays on said display the partial image concerning a floor designated among the plurality of floors.

* * * * *